US005823250A

United States Patent [19]

Barten et al.

[11] Patent Number: 5,823,250

[45] Date of Patent: Oct. 20, 1998

[54] INTEGRALLY EXTRUDED RADIATOR TANK AND OIL COOLER

[75] Inventors: Brian Leslie Barten, Lockport; John Kenneth Spoth, Clarence Ctr, both of N.Y.

[73] Assignee: General Motors Corporation, Detroit, Mich.

[21] Appl. No.: 927,123

[22] Filed: Sep. 5, 1997

[51] Int. Cl.[6] ..... F28D 7/10

[52] U.S. Cl. ..... 165/140; 165/169; 165/916

[58] Field of Search ..... 165/140, 168, 165/169, 916

[56] References Cited

U.S. PATENT DOCUMENTS

| | | | |
|---|---|---|---|
| 1,664,628 | 4/1928 | Kessler | 165/168 |
| 2,572,972 | 10/1951 | Baldwin | 165/168 |
| 3,116,541 | 1/1964 | Nickol et al. | 165/140 |
| 3,265,126 | 8/1966 | Donaldson | 165/140 |
| 4,353,416 | 10/1982 | Buschfeld | 165/168 |
| 4,448,242 | 5/1984 | Andres et al. | 165/140 X |
| 4,834,171 | 5/1989 | Larrabee et al. | 165/140 |
| 4,903,760 | 2/1990 | Joshi et al. | 165/140 X |
| 5,129,144 | 7/1992 | Halstead et al. . | |
| 5,636,685 | 6/1997 | Gawve et al. . | |

FOREIGN PATENT DOCUMENTS

| | | | |
|---|---|---|---|
| 54590 | 3/1988 | Japan | 165/916 |

*Primary Examiner*—Leonard R. Leo
*Attorney, Agent, or Firm*—Patrick M. Griffin

[57] ABSTRACT

A radiator tank is co extruded with an interior chamber, which is subdivided into at least two subchambers by at least one integral dividing web. The web is recessed from one end cap of the tank by a clearance space, but brazed to the other end cap of the tank. An oil inlet opens into one subchamber, remote from the clearance space, and an oil outlet opens into the other subchamber, also remote from the clearance space. Radiator coolant is conventionally fed into the remainder of the tank, sealed from the subchambers, but thermally exposed thereto across a common inner wall. Oil fed into one of the subchambers is forced to follow an efficient, serpentine path that is an integer multiple of the total end to end length of the basic tank, enhancing conduction.

2 Claims, 2 Drawing Sheets

INTEGRALLY EXTRUDED RADIATOR TANK AND OIL COOLER

TECHNICAL FIELD

This invention relates to radiator tanks having an integral oil cooler, and specifically to such a tank with an improved, serpentine flow path provided within the integral oil cooler.

BACKGROUND OF THE INVENTION

Oil coolers found in production vehicles are typically stacked, multi-plate constructions, which are mounted separately inside the plastic molded radiator tank and plumbed with an oil inlet and outlet that open through the plastic tank wall to the outside. Coolant is fed to the radiator tank, and washes over the outside of the oil cooler within. Oil is fed independently into the oil cooler, and conducts oil heat to the radiator coolant. Obviously, the oil cooler plate stack must be carefully, internally sealed to prevent a cross exchange of oil and radiator coolant inside the tank. Just as important, the oil inlet and outlet must be carefully sealed where they pass through the radiator tank wall so as to prevent leakage of radiator coolant to the outside. A stacked plate oil cooler disclosed in co assigned U.S. Pat. 5,636,685 issued Jun. 10, 1997 to Gawve et al. is exemplary of this basic oil cooler design, improved as to internal oil flow, but still a separate structure from the radiator tank itself.

Patented designs propose to integrate the oil cooler into the radiator coolant tank in such a way as to reduce or eliminate the possibility of oil-coolant cross exchange, while having oil inlets and outlets that do not create a potential leakage of radiator coolant to the outside. Co assigned USPN 4,903,760 issued Feb. 27, 1990 to Joshi et al. shows an oil cooler co-extruded or co-molded with a plastic radiator tank, with a shared, coextensive internal wall. The inlet and outlet to the oil cooler pierce only a wall of the oil cooler, and do not, therefore, inevitably create a potential radiator coolant leak path to the outside. Co assigned USPN 5,129,144 issued Jul. 14, 1992 to Halstead et al. discloses a similar design extruded in metal, rather than plastic.

The advantage of a traditional stacked plate oil cooler is the large conductive surface area it presents to the radiator coolant in which it is bathed, and also the tortuous path that the oil is forced through within the oil cooler interior, both of which enhance heat exchange. The integral-to-tank oil cooler designs proposed in the above noted patents also disclose fins and other heat conduction enhancing structures for the oil cooler, internal or external thereto. However, the oil flow paths disclosed are straight flow paths, and are therefore limited in length to the end to end length of the oil cooler-radiator tank itself.

SUMMARY OF THE INVENTION

The subject invention provides a co-extruded, integral oil cooler and radiator tank in which the oil flow path within the oil cooler section of the tank is serpentine, with a total path length that is a multiple of the end to end length of tank.

In the preferred embodiment disclosed, a tank body comprises an elongated, integral axial extrusion, generally rectangular in cross section, and initially open at each end. One outer wall of the tank body comprises a slotted header, which connects to a conventional radiator core. At least one of the three other outer walls of the tank body has an inner wall running parallel thereto, and coextensive with the tank body, providing a separate, interior chamber. The interior chamber is not unitary, however, but is subdivided at least once by at least one integral dividing web, which joins the inner and outer walls. The web extends from a point flush at one end of the tank body nearly to, but terminates short of the other end of the tank body. Caps are sealed to the edges of both ends of the tank body, thereby enclosing the interior and sealing the subchambers from the remainder of the tank, which will contain coolant. When a first cap is sealed to the one end of the tank body, the flush edge of the web seals to the inner surface of the first cap, as do the other edges of the inner and outer tank body walls. However, when a second cap is sealed to the other end of the tank body, it seals to the edges of the tank body inner and outer walls, but not to the non-flush edge of the integral web. A narrow axial clearance space is left instead, interconnecting the two subchambers. When more than one web divides the interior chamber into more than two adjacent subchambers, the webs terminate short of opposite ends of the tank body, in an axially alternating pattern.

Another outer wall of the tank body is provided with a conventional coolant inlet and/or outlet, so that coolant is thermally exposed to the subchambers across the inner wall, but physically sealed therefrom. An oil inlet opens to the first of the subchambers at a point axially remote from the axial clearance space in the nearest web, and an oil outlet opens to the last of the subchambers, also at a point axially remote from the clearance space in the nearest web. The oil inlet and outlet open only into the subchambers, and thus do not provide potential leak points for coolant. The physical relationship of the oil inlet and outlet, remote from the axial clearance spaces in the nearest webs, causes the oil entering the inlet to flow axially in one direction, along the length of the subchamber that it enters, then through the remote axial clearance space, then in the opposite axial direction along the length of next subchamber, and so on, in a serpentine pattern, until it exits the oil outlet in the last subchamber. The oil thus flows over at least twice the basic length of the tank. As it flows back and forth through the subchambers, it is continually thermally exposed to coolant across the inner wall.

BRIEF DESCRIPTION OF THE DRAWINGS

These and other features of the invention will appear from the following written description, and from the drawings, in which.

DESCRIPTION OF THE PREFERRED EMBODIMENT

Figure 1:
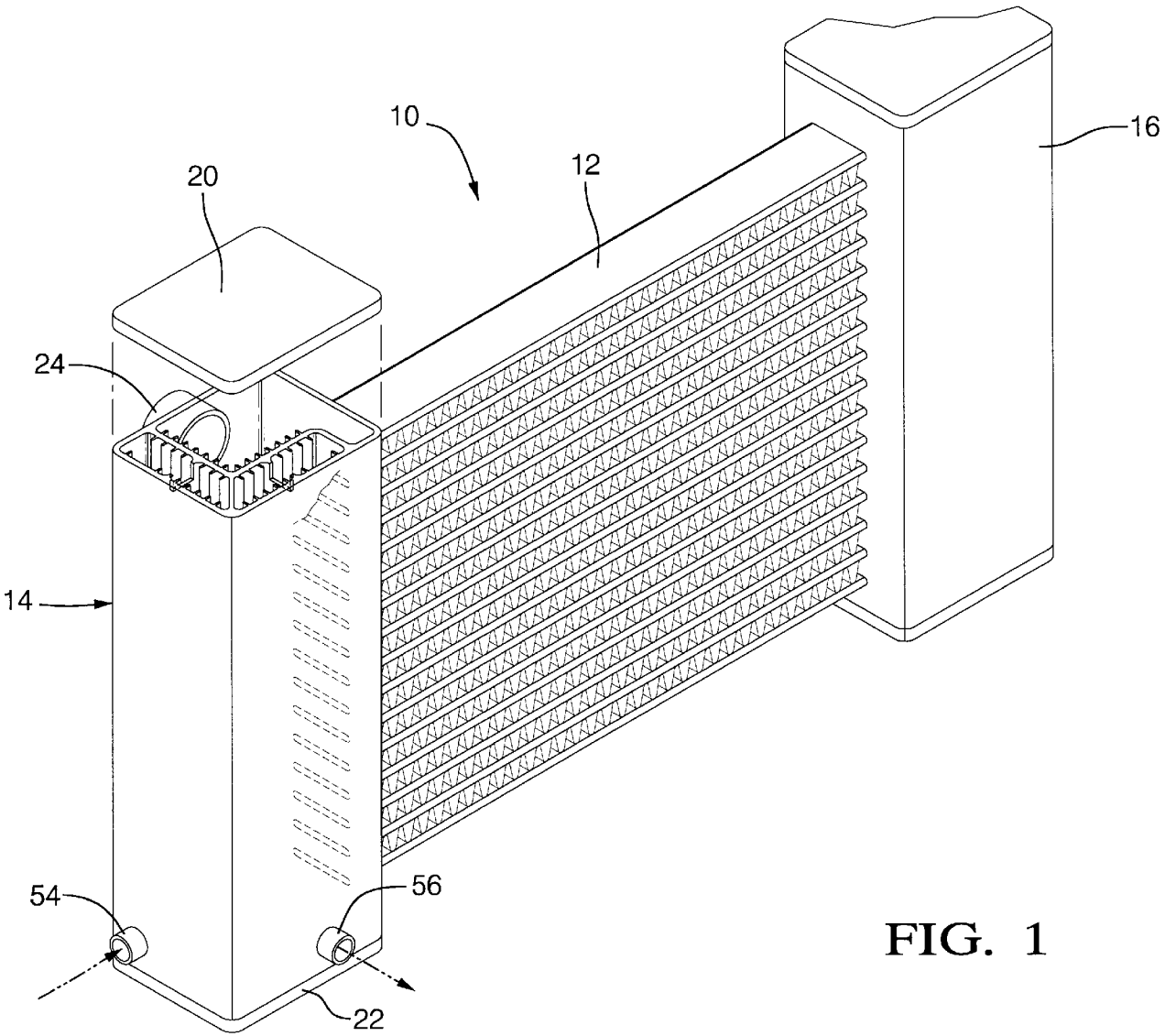
FIG. 1 is a perspective view of a preferred embodiment of a radiator and oil cooler.

Referring first to FIG. 1, a preferred embodiment of a combined radiator and oil cooler made according to the invention, indicated generally at 10, comprises three basic components. A standard radiator core 12 provides flow passages for radiator coolant, and dumps the heat therefrom to ambient. Two manifold tanks, indicated generally at 14 and 16, border the core 12, and feed coolant into and out of the core 12 in conventional fashion. At least one manifold tank 14 comprises an extruded tank body, indicated generally at 18 which, in combination with top and bottom end caps 20 and 22 and other internal structures, forms an integral oil cooler within tank 14.

Figure 2:
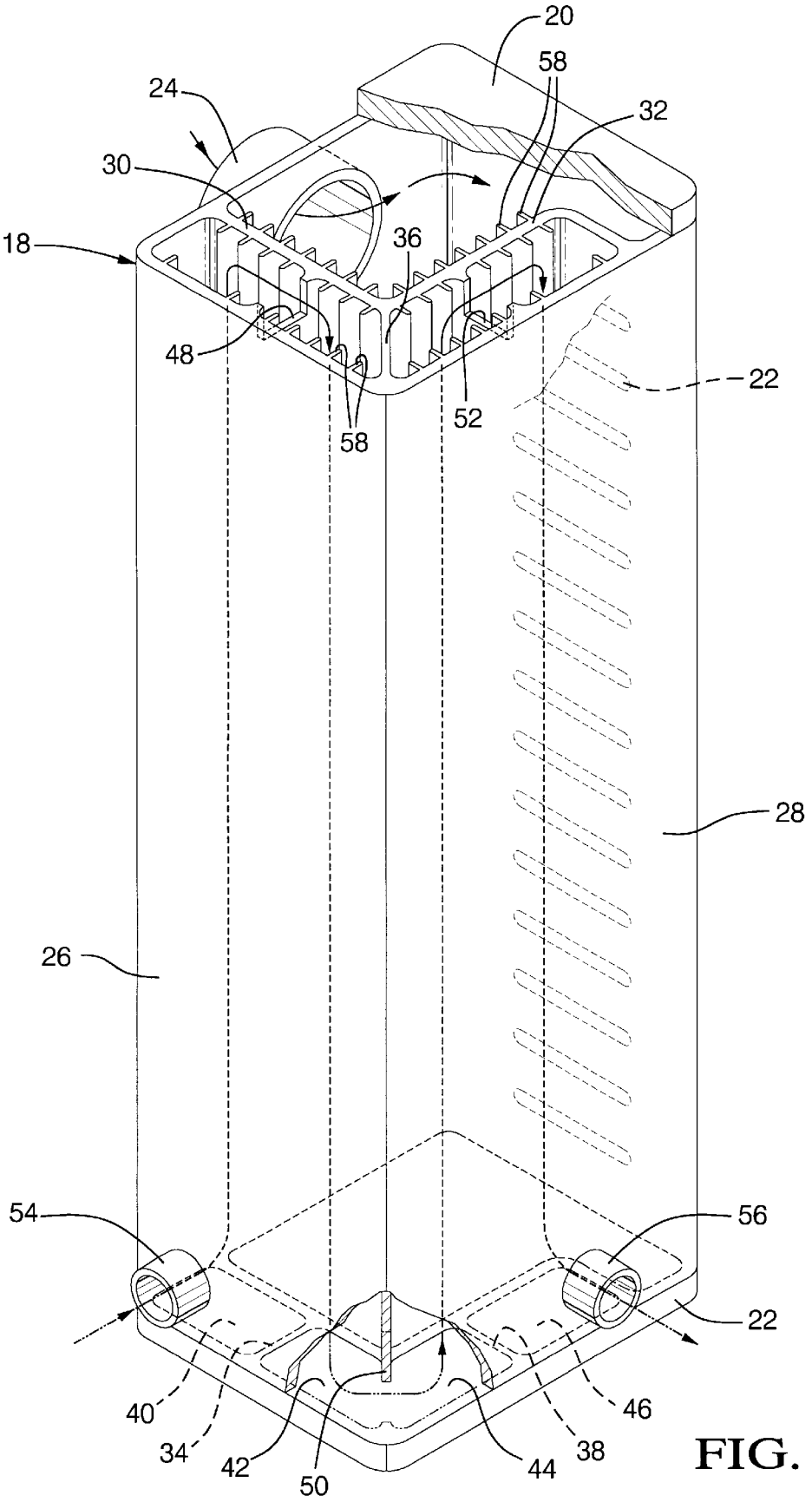
FIG. 2 is a perspective of one tank, with caps partially broken away to better illustrate the serpentine oil flow path.

Referring next to FIG. 2, tank body 18 is an axially elongated, hollow metal extrusion, preferably of aluminum alloy, with a generally rectangular cross section, cut to length to provide square top and bottom end edges. One outer wall of the tank body 18 provides a slotted header 22 to feed coolant into or out of the core 12. The header 22 could also be a separate plate, joined later to a three sided tank body, without affecting the operation of the oil cooler described below. However, with an all aluminum tank 14 and core 12, the option of integrating the header 22 into one side of a four sided tank body 18 is feasible and practical, since all components can be brazed in one operation. One of the other four outer tank walls includes a conventional radiator coolant inlet/outlet 24, which would be matched to a similar coolant outlet/inlet, not illustrated, on the other tank 16. Of the other two outer walls, one, 26, is opposed to the header 22, and the other, 28, forms an exterior corner with outer wall 26. A pair of inner walls 30 and 32 are also integrally extruded end to end with the tank body 18, each with their top and bottom end edges flush to the top and bottom end edges of the tank body 18 itself, and also forming an interior corner. Each inner wall 30 and 32 is coextensive with and parallel to a respective outer wall 26 and 28, thereby segregating a basic interior chamber within tank body 18. The inner walls 30 and 32 are maintained rigidly spaced from their respective outer walls 26 and 28 by a series of three interior integral webs, numbered 34, 36 and 38 in succession. The central interior web 36 joins the interior and exterior corners of the outer and inner wall pairs 26–30 and 28–32. The other two webs, 34 and 38, join the approximate centers of the wall pairs 26–30 and 28–32. The three webs 34, 36 and 38 together serve to subdivide the main interior chamber into four parallel subchambers, numbered 40, 42, 44 and 46, in succession. The three webs 34, 36 and 38 are, initially, extruded flush at both ends to the edges of the parallel wall pairs 26–30 and 28–32. However, before the caps 20 and 22 are installed, each web 34, 36 and 38 has one of its end edges notched and recessed axially inwardly, at alternating ends of the tank body 18, so as to leave three small axial clearance spaces, numbered 48, 50 and 52 in succession. When the end caps 20 and 22 are brazed to the ends of the tank body 18 to complete and enclose it, the flush end edges of the inner outer wall pairs 26–30 and 28–32 are sealed to the inner surfaces of the caps 20 and 22, as are the remaining flush end edges of the webs 34, 36 and 38. The alternating clearance spaces 48, 50 and 52 remain at the recessed web end edges, however, opening adjacent subchambers 40, 42, 44 and 46 to one another, at alternating ends of the tank body 18. An oil inlet 54 is installed through the outer wall 26 and opens into the first subchamber 40, at the bottom of tank body 18, or, more significantly, at a point axially remote from the axial clearance space 48 in the nearest dividing web 34. Also, an oil outlet 56 is installed through the outer wall 28, opening into the last subchamber 46, also near the bottom of tank body 18 and axially remote from the axial clearance space 52 in the nearest dividing web 38. Neither oil fitting 54 or 56 represents a potential coolant leak path. Finally, in the embodiment disclosed, both surfaces of the two inner walls 30 and 32, and the inner surfaces of the two outer walls 26 and 28, are extruded with integral conductive fins 58.

Still referring to FIG. 2, the operation of the integral radiator and oil cooler 10 is illustrated. Radiator (engine) coolant is introduced into one manifold tank, into the inlet 24 in the tank 14 as disclosed, as shown by the arrow. The coolant fills the interior of tank 14, but is blocked from the subchambers 40 through 46 by the brazing of the inner surfaces of the caps 20 and 22 to the flush end edges of the inner and outer wall pairs 26–30 and 28–32. The coolant is thermally exposed to the entire inner surface of the inner walls 30 and 32, however, and to the fins 58 formed integrally therewith. Whatever additional heat the coolant picks up by this exposure is sent to the core 12 and ultimately to ambient, along with normally expelled engine heat. Concurrently, hot oil from the engine or transmission is sent to inlet 54, and into the first subchamber 40. The oil flows axially up the entire length of subchamber 40, through the first encountered axial clearance space 48, then axially down the length of the second subchamber 42, completing two legs of a four sided serpentine path. From there, oil flows through the next encountered axial clearance space 50, up the length of the third subchamber 44, through the final encountered axial clearance space 52, and down the final, fourth subchamber 46 and out the outlet 56, completing the last two legs of the serpentine path. Over the entire flow path, which constitutes four multiples of the end to end length of the tank body 18, the hot oil is exposed to the finned inner surfaces of the inner walls 30 and 32, thermally exposed to the coolant for an extended flow time and over a large surface area. This lends itself to a far more efficient heat exchange than would a simple, end to end straight flow path, as is disclosed for other integral oil coolers. This multi-leg, serpentine oil path is achieved with no extra components or manufacturing steps, apart from cutting the three clearance notches 48, 50 and 52, which is minor. The tank body 18 has to be extruded, its end caps 20 and 22 have to be brazed on, and the oil inlets and outlets 54 and 56 have to be provided regardless.

Variations in the preferred embodiment could be made. A longer flow path with more surface area could be created with three inner walls, one parallel to each of the three available tank body outer walls, and five dividing webs, thereby forming six total subchambers, instead of just four. Those subchambers could be subdivided again by even more webs, increasing the flow path length, but not its total surface area. Or, a shorter flow path could be obtained with as few as one pair of inner and outer walls, divided by a single integral web. The basic manufacturing and assembly process would be the same regardless, with simply more or fewer clearance notches being cut into alternate ends of more or fewer dividing webs. One simple variant would be to provide both inner walls 30 and 32 as shown, but divided into only two, relatively wide subchambers by a single dividing web 36 joining the interior and exterior corners. The fins 58 could be eliminated, but can be just as easily extruded integrally to the tank body 18 as not, and would likely be included for that reason. Therefore, it will be understood that it is not intended to limit the invention to just the embodiment disclosed.

We claim:

1. An integrated radiator coolant manifold tank and oil cooler for automotive use, comprising:

an axially extruded, elongated tank body of generally rectangular cross section having first and second open ends, a pair of outer walls forming an exterior corner, a pair of inner walls axially coextensive with and parallel to said outer walls and forming an interior corner, and an integral web connecting said exterior and interior corners to define a pair of parallel interior subchambers, said web extending flush from said tank body first open end toward said other tank body second open end, but terminating short of said second open end;

a first cap sealed to said tank body first open end and sealed to said integral web;

a second cap sealed to said tank body second open end, but with an axial clearance space relative to said integral web;

an oil inlet opening into one of said subchambers remote from said clearance space; and, an oil outlet opening into the other of said subchambers remote from said clearance space;

whereby coolant may be fed into said tank body, sealed from said subchambers by said inner walls and caps, while oil may be fed into said oil inlet, sealed from the rest of said tank body by said inner walls and caps, to flow along the length of one subchamber and through said axial space into and along the length of the other subchamber and ultimately out of said oil outlet, thereby following a serpentine flow path through said tank body while thermally exposed to coolant across said inner walls.

2. An integrated radiator coolant manifold tank and oil cooler for automotive use, comprising:

an axially extruded, elongated tank body of generally rectangular cross section having first and second open ends, a pair of outer walls having an exterior corner, a pair of inner walls axially coextensive with and parallel to said outer walls and having an interior corner, said inner walls further comprising coextensive integral fins extending from each side thereof, said tank body further comprising an integral web connecting said exterior and interior corners to define a pair of parallel interior subchambers, said web extending axially flush from said tank body first open end toward said other tank body second open end, but terminating short of said second open end;

a first cap sealed to said tank body first open end and sealed to said integral web;

a second cap sealed to said tank body second open end, but with an axial clearance space relative to said integral web;

an oil inlet opening into one of said subchambers remote from said clearance space; and, an oil outlet opening into the other of said subchambers remote from said clearance space;

whereby coolant may be fed into said tank body, sealed from said subchambers by said inner walls and caps, while oil may be fed into said oil inlet, sealed from the rest of said tank body by said inner walls and caps, to flow along the length of said one subchamber and through said axial space and into and along the length of the other subchamber and ultimately out of said oil outlet, thereby following a serpentine flow path through said tank body while thermally exposed to coolant across said inner walls and integral fins.

* * * * *